US006158988A

United States Patent [19]

Jäger

[11] Patent Number: 6,158,988

[45] Date of Patent: Dec. 12, 2000

[54] METHOD OF PRODUCING ELASTOMERIC STATORS FOR ECCENTRIC SPIRAL PUMPS

[75] Inventor: Sebastian Jäger, Hannover, Germany

[73] Assignee: Artemis Kautschuk - und Kunststofftechnik GmbH & Cie, Germany

[21] Appl. No.: 09/208,811

[22] Filed: Dec. 9, 1998

[30] Foreign Application Priority Data

Dec. 10, 1997 [DE] Germany ..... 197 54 818

[51] Int. Cl.[7] ..... F04C 5/00

[52] U.S. Cl. ..... 418/48; 418/178; 418/153; 29/888.023

[58] Field of Search ..... 418/48, 178, 153; 29/888.023

[56] References Cited

U.S. PATENT DOCUMENTS 5,171,139 12/1992 Underwood et al. ..... 418/48
5,318,416 6/1994 Hantschk et al. ..... 418/48
5,759,019 6/1998 Wood et al. ..... 418/48

FOREIGN PATENT DOCUMENTS 2722623 2/1984 Germany ..... 418/178
3229446 2/1984 Germany ..... 418/178

*Primary Examiner*—Thomas Denion
*Assistant Examiner*—Thai-Ba Trieu
*Attorney, Agent, or Firm*—Robert W. Becker & Associates

[57] ABSTRACT

The method of producing an elastomeric stator, and a stator produced by such method are provided. On its outside, the stator has a metallic spiral body, the shape of which corresponds to that of a hollow pump chamber. Elastomeric material is injected into a mold that contains the spiral body in order to form an elastomeric lining of the body. The elastomeric materials are introduced into the mold in such a way that the outer surface of the elastomeric lining merely rests against the spiral body and is not bonded or otherwise fixedly connected thereto.

10 Claims, 1 Drawing Sheet

METHOD OF PRODUCING ELASTOMERIC STATORS FOR ECCENTRIC SPIRAL PUMPS

BACKGROUND OF THE INVENTION

The present invention relates to a method of producing elastomeric stators, and in particular such stators that on the outside have a metallic spiral or helical body that has a shape corresponding at least essentially to that of the hollow chamber that is surrounded by the elastomer, in other words is essentially shaped in the manner of a spiral tube. The invention is furthermore related to such previously described stators with which the elastomeric coating is formed by injecting an elastomer into a mold that contains the body and a core for the configuration of the hollow pump chamber.

Since eccentric spiral pumps are predominantly used with material that is enriched with foreign matter or is entirely pasty, the elastomeric lining of the rigid body that surrounds the hollow pump chamber is subjected to considerable mechanical stress. As a result, considerable wear occurs. On the whole, the elastomeric lining is, however, also stressed in the axial direction of the stator body due to the helical shape of the rotors. For these reasons, pursuant to heretofore known proposals the elastomeric lining, which generally comprises rubber, is adhesively or otherwise fixedly connected to the inner surface of the rigid body.

It is therefore an object of the present invention to simplify the aforementioned manufacturing process for elastomeric stators without impairing the durability of the pumps.

SUMMARY OF THE INVENTION

To realize this object, pursuant to the present invention the elastomer is introduced into the mold in such a way that it merely comes into contact with the body, yet does not produce a fixed connection therewith. Consequently, the stator manufacture starts with a non prepared body for which it is not even necessary to clean it after its manufacture from an elongated tubular member. In addition, the elastomer can be specifically selected for its requirement in an eccentric spiral pump; a consideration of readily bondable elastomeric mixtures is eliminated.

Tests have shown that even after long periods of operation of the associated pump, stators manufactured pursuant to the present invention, although they are subjected to considerable pressing work, show no damage; the pumps equipped with the inventively manufactured stators also surprisingly show no deficiencies relative to such pumps where the elastomeric lining is adhered or bonded on the inside to the helical or spiral body.

It should be noted that the present invention is not limited to special shapes of the end portions of the metallic body. However, the invention is preferably used in conjunction with such bodies where the end portions, which on the whole are kept short, are practically cylindrical or, however, are angled or bent off slightly radially inwardly.

BRIEF DESCRIPTION OF THE DRAWING

Further details of the present intention will be explained subsequently with the aid of the schematic drawing, which illustrates one exemplary embodiment for the inventive method and special end portions for the stator body. In the drawing.

DESCRIPTION OF PREFERRED EMBODIMENTS

Figure 1:
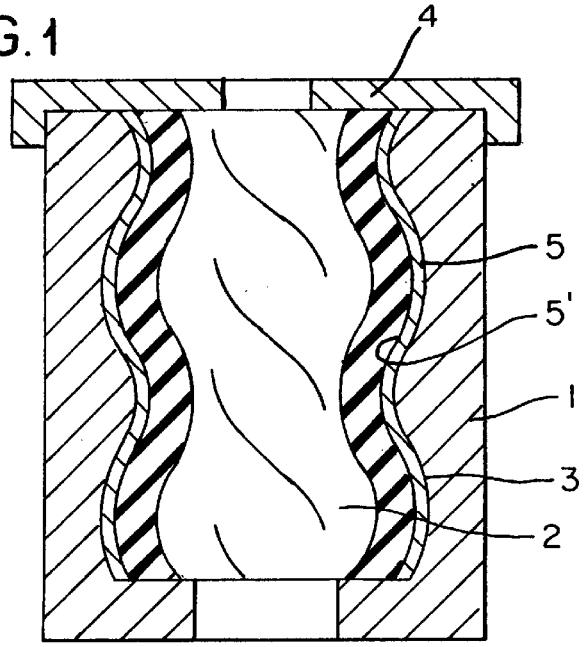
FIG. 1 is a cross-sectional view through an injection mold for forming stators for eccentric spiral pumps.

Referring now to the drawing in detail, the hollow outer portion 1 of the mold is centrally provided with a core 2, which on the outer side is formed in the manner of a double thread; the inner surface 3 of the outer portion 1 has a corresponding configuration. At the top, the mold is closed off by a cover 4, which also serves for holding the core 2 at the upper end.

It is to be understood that the mold of FIG. 1 is shown only schematically and that the mold must have further details and features, for example means that serve for the injection of material.

For the manufacture of the stator, a double wound or spiral steel tube 5, the outside of which corresponds to the inner surface 3 of the outer portion 1, is first placed into the mold; especially the inner surface 5' of this tube 5 is untreated, in other words is practically in the state that resulted from its manufacture from a cylindrical tube. Rubber is then injected into the hollow mold chamber, in other words into the space between the inner surface 5' of the tube 5 and the outer surface of the core 2. Due to its composition and nature, the rubber produces no bond, i.e. no fixed connection, with either the core 2 or the helical tube 5; thus, the rubber also does not have to be prepared or selected with regard to a rubber-metal bond.

After hardening or vulcanization, the stator is finished. It can then readily and without further treatment be conventionally installed in a pump jack.

Figure 2:
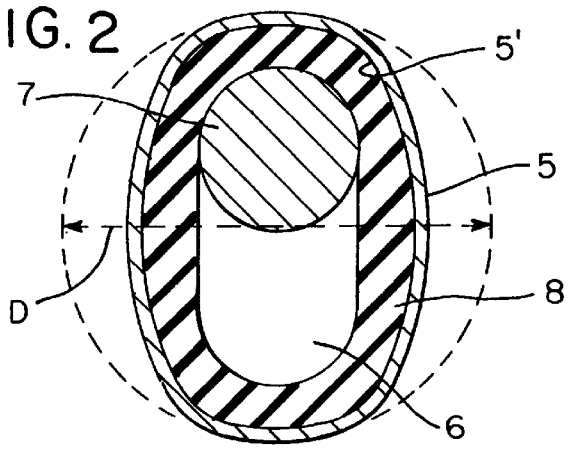
FIG. 2 is a cross-sectional view of a stator produced in the mold of FIG. 1 together with a rotor.

FIG. 2 shows a position of a single wound or spiral pump rotor 7 disposed within the hollow pump chamber 6. It can also be seen that with the finished pump, due to the shape of the tube 5, i.e. the stator surface formed by the tube, the hollow pump chamber 6 is surrounded by a rubber layer 8 of approximately uniform thickness.

Although the rubber layer 8 is not bonded or adhesively connected, it undergoes no undesired shifting of position due to the form fit between the outer surface of the rubber layer 8 and the tube 5.

Figure 3:
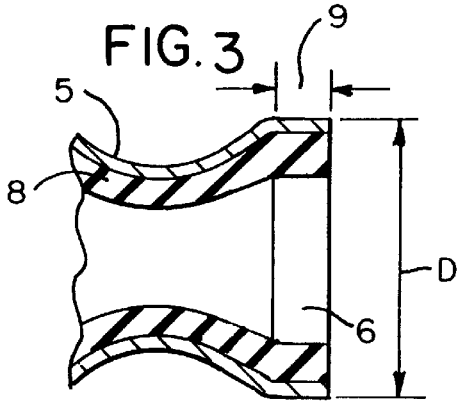
FIGS. 3 and 4 are longitudinal cross-sectional views of different end portions of a stator for an eccentric spiral pump.
Figure 4:
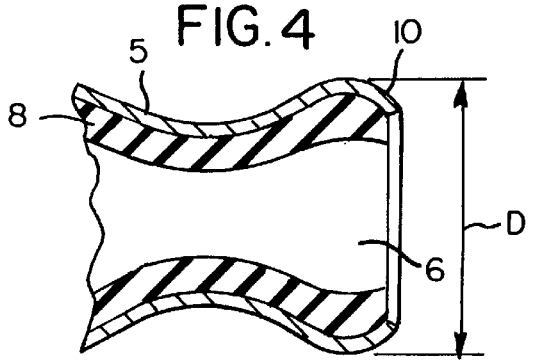

As shown in FIGS. 3 and 4, this form fit can be further enhanced. For this purpose, as shown in FIG. 3 the tube 5 is provided at one end, and preferably however at both ends, with a cylindrical end portion 9, the diameter D of which is essentially disposed at the diameter of the greatest bulge of the tube 5. In the embodiment of FIG. 4, an end portion 10 can be provided at the conclusion of an end portion 9 or immediately at the conclusion of the helical form; this end portion 10 is angled off radially inwardly, or as illustrated, is bent off. This also improves the form fit.

The present invention does not preclude the ends of the helical tube 5 from being machined during manufacture thereof, for example via a turning operation. However, in every case the normally required preparation of the adhesive surface, in other words the inner surface of the tube 5, for an elastomer-metal bond or a rubber-metal bond is superfluous since the aforementioned bond is no longer required.

The specification incorporates by reference the disclosure of German priority document 197 54 818.0 of Dec. 10, 1997.

The present invention is, of course, in no way restricted to the specific disclosure of the specification and drawing, but also encompasses any modifications within the scope of the appended claims.

What I claim is:

1. A method of producing an elastomeric stator that on the outside has a metallic spiral body, the shape of which corresponds to that of a hollow pump chamber, comprising the steps of:

disposing said spiral body in a mold; and injecting elastomeric material into said mold to form an elastomeric lining of said body, wherein said elastomeric material is introduced into said mold in such a way that it merely comes into contact with said spiral body but does not produce a fixed connection therewith.

2. A method according to claim 1, wherein said spiral body is formed from an elongated tube, and wherein said body is disposed in said mold without intermediate treatment of at least one surface of said body.

3. A method according to claim 2, wherein said spiral body is disposed in said mold without intermediate treatment of an inner surface thereof.

4. A stator, for eccentric spiral pumps, produced in accordance with the method of claim 1, wherein said elastomeric lining of said stator extends to ends of said spiral body, and wherein an outer surface of said elastomeric lining of said stator merely rests against said spiral body and is not bonded thereto.

5. A stator according to claim 4, wherein at least one end of said spiral body has an essentially cylindrical end portion.

6. A stator according to claim 5, wherein said at least one cylindrical end portion has a diameter that essentially corresponds to a diameter of said spiral body in the vicinity of bulges thereof.

7. A stator according to claim 4, wherein at least one end of said spiral body is angled or bent radially inwardly.

8. A stator according to claim 5, wherein at least one end of said spiral body is angled or bent radially inwardly.

9. A method according to claim 1, which includes, after said injecting step, the step of vulcanizing said stator, wherein said elastomeric material continues to remain not bonded to said spiral body.

10. A stator according to claim 4, wherein inner and outer surfaces of said spiral body have a corresponding helical shape.

* * * * *